175-48 SR
10/20/81 XR 4,295,366

United States Patent [19] [11] 4,295,366
Gibson et al. [45] Oct. 20, 1981

[54] DRILLING FLUID CIRCULATING AND MONITORING SYSTEM AND METHOD

[75] Inventors: Joseph T. Gibson; Gerald L. Duhon, both of New Iberia, La.

[73] Assignee: A. C. Company, New Iberia, La.

[21] Appl. No.: 42,969

[22] Filed: May 29, 1979

[51] Int. Cl.[3] ..... E21B 47/04
[52] U.S. Cl. ..... 73/155; 73/304 C; 175/48
[58] Field of Search ..... 73/153, 816.08, 816, 73/302, 304 C, 155, 215; 175/25, 38, 40, 48, 206

[56] References Cited

U.S. PATENT DOCUMENTS

| | | | |
|---|---|---|---|
| 1,843,552 | 2/1932 | Gibson et al. | 73/215 X |
| 1,975,710 | 10/1934 | Borden | 73/215 |
| 3,427,878 | 2/1969 | Gerlitz, Jr. et al. | 73/215 |
| 3,602,322 | 8/1971 | Gorsuch | 175/48 |
| 3,726,136 | 4/1973 | McKean et al. | 175/48 X |
| 3,740,739 | 6/1973 | Griffin et al. | 175/48 X |
| 4,038,871 | 8/1977 | Edwards | 73/304 C |
| 4,043,193 | 8/1977 | Bailey | 73/155 |
| 4,127,030 | 11/1978 | Martig, Jr. | 73/861 |
| 4,134,294 | 1/1979 | Patillet et al. | 73/153 |

*Primary Examiner*—James A. Leppink
*Attorney, Agent, or Firm*—Guy E. Matthews

[57] ABSTRACT

A drilling fluid monitoring system and method includes a pump stroke counter providing an electrical signal representing the volume of drilling fluid pumped into a well, a flow sensing device providing an electrical signal representing the volume of drilling fluid flowing out of the well, fluid level an electrical measuring device providing an electrical signal representing the fluid level changes within a tank, and a device receiving the electrical signals emitted by the pump stroke counter, flow sensor and measuring device to indicate changes in the circulation of the well drilling fluid.

15 Claims, 4 Drawing Figures

DRILLING FLUID CIRCULATING AND MONITORING SYSTEM AND METHOD

REFERENCE TO RELATED APPLICATION

This applicaton is related to U.S. application Ser. No. 42,777, filed May 29, 1979, entitled DRILLING FLUID CIRCULATING AND MONITORING SYSTEM AND METHOD.

FIELD OF THE INVENTION

This invention relates generally to drilling fluid monitoring systems for well drilling apparatus and more specifically concerns flow conduit apparatus that simplifies detection and monitoring of the rate of flow of drilling fluid exiting the well bore being drilled, and thus promotes rapid detection of drilling fluid losses into the earth formation.

BACKGROUND OF THE INVENTION

When rotary drilling for petroleum producing wells, it is well known that drilling fluids provide multipurpose uses, such as to remove drill cuttings from the bottom of the hole to prevent interference with the cutting action of the drill bit, to cool and lubricate the drill bit and drill stem and to transport the cuttings to the surface. The drilling fluid also provides support for the walls of the well bore to prevent sloughing of soft formations and provides sufficient hydrostatic head pressure to prevent entry of formation fluids into the well bore. Further, the drilling fluid provides a filter cake lining for the well bore to prevent loss of drilling fluid into certain types of earth formations.

As explained in the above-identified related application, conventional apparatus used for circulating the drilling fluid, typically referred to in the industry as drilling mud, into the well bore typically includes a pump to force the drilling fluids through a hose and swivel into a kelly, which is a non-circular tube that is rotatated by means of a rotary drive mechanism having a non-circular opening through which the kelly is lowered while being continuously rotated. The drilling fluid then flows downwardly through sections of drill stem connected to the kelly and, after exiting the drill bit at the lower extremity of the drill stem, flows upwardly through the annulus between the drill stem and well bore. The drilling fluid then exits the well bore through a fluid return line connected to the well head and is discharged into a settling tank or pit or a series of tanks from which the pump returns the drilling fluids to the well. To monitor this circulation, the related application describes an improved system to measure the level of drilling fluid stored in the tank, as well as the flow of drilling fluid into and out of the well. The monitoring system described in the related application is incorporated in this application by reference to simplify a complete understanding of this invention.

Although the flow of drilling fluid returning from the well bore through the wellhead and passing through the return line can be measured as explained in the related application, it has been found that it is extremely difficult to determine the flow rate of fluid flowing through a pipe with a circular internal cross-section under circumstances where the pipe is less than completely filled with fluid. This difficulty exists because, as the fluid level changes within the pipe, the arc across the pipe varies and thus the cross-sectional area defined by the fluid within the pipe also varies. Because of the partially circular cross-sectional configuration defined by the fluid within the return line, it is extremely difficult to determine the flow rate of fluid returning from the well bore. Accordingly, it is desirable to provide apparatus that simplifies the measurement of the volume of drilling fluid flowing through the return line.

One of the more important functions provided by the drilling fluid is the maintenance of sufficient hydrostatic head within the well bore to maintain a bottom hole pressure that will exceed the formation pressure of any formation intersected by the well bore. If the hydrostatic head pressure is insufficient due to losses of fluid into the formation, the possibility of a well blowout increases substantially.

Accordingly, it is a primary object of the present invention to facilitate a simplified determination of the volume of drilling fluid flowing through a drilling fluid return line by including a portion in such line which has an internal cross-section of parallelogram shape and measuring the flow of drilling fluid returning to the surface by measuring the level of fluid flowing through the parallelogram cross-section.

It is also a feature of the present invention to provide novel means for monitoring the drilling fluid system of well drilling apparatus such that a comparison is provided that indicates drilling fluid being pumped into a well bore and drilling fluid flowing from the well bore.

It is another feature of this invention to provide a novel drilling fluid monitoring system wherein electrical signals representing the level of drilling fluid within the holding tanks, the volume of drilling fluid pumped into the well and the volume of drilling fluid flowing from the well are correlated electronically and displayed for visual inspection.

An even further feature of this invention concerns the provision of a drilling fluid monitoring system wherein an electrical signal reflecting the volume of flow of drilling fluid exiting the well bore is displayed graphically to provide a rapid means for detecting loss of drilling fluid to the formation being drilled.

Other and further objects, advantages and features of this invention will become apparent to one skilled in the art upon consideration of the teachings hereof. The form of the invention, which will now be described in detail, illustrates the general principles of the invention, but it is to be understood that this detailed description is not to be taken as limiting the scope of the invention.

SUMMARY OF THE INVENTION

In accordance with the invention, a drilling fluid monitoring system comprises a measuring means mounted with a drilling fluid storage tank or tanks and providing an electrical output signal that identifies the level of the drilling fluid contained within the tank or tanks. A pump stroke counter is mounted with a drilling fluid circulation pump and provides an output representative of the volume of drilling fluid being pumped from the tank through the drill stem to the bit at the bottom of the well bore. A volumetric flow sensor is connected to a drilling fluid return line that returns the drilling fluid from the well to the tank and provides an electrical output that identifies the level of fluid flowing through an intermediate section of the return line. To facilitate ease of volumetric flow measurement, the intermediate section of the return line is formed internally to define a flow measurement section or chamber having a parallelogram internal configuration. The flow measurement chamber or section functions to convert the flowing drilling fluid from a partially circular cross-sectional configuration to a parallelogram cross-sectional configuration and thus provides for simplified, efficient volumetric measurement. The liquid level related signal being emitted from the sensor of the flow measurement chamber is readily correlated with the signal reflecting the pump injection volume and these correlated signals are displayed to provide drilling personnel with information from which activities concerning the drilling fluid can be efficiently programmed. Volumetric measurement apparatus is (i) mounted with the measuring means for indicating the amount of drilling fluid contained within the tank, (ii) mounted with a pump stroke counter for indicating the quantity of drilling fluid pumped into the well, and (iii) mounted with the flow sensor for indicating the quantity of fluid flowing from the well into the tank. Electrical signals representing these volumetric measurements are processed and correlated electronically to provide a readout that may be visually inspected.

Further, in accordance with the invention, a method of monitoring changes in fluid circulation of a drilling fluid circulation system comprises recording an output from a measuring device mounted with a drilling fluid storage tank and providing a signal representing the quantity of fluid supported within such tank. The number of strokes of a drilling fluid circulating pump are counted electronically and a signal is provided representing the volume of fluid being pumped into the well from the tank. The volume of drilling fluid returning from the well is determined by a fluid level measuring device that senses the level of fluid within the return line. This measurement is simplified by providing the return line with an intermediate section of parallelogram shaped internal cross-section. The electrical output from the fluid level sensing device, which is mounted in the intermediate section of the drilling fluid return line, is recorded to determine the volume of fluid flowing into the tank from the well.

Further, in accordance with the invention, a drilling fluid circulating system includes a tank for storing a quantity of drilling fluid used during drilling of the well. A drilling fluid pump and conduit system is mounted in fluid communication with the tank for pumping the stored drilling fluid through the drill stem into the well and a drilling fluid return line is mounted in fluid communication with the upper portion of the well for transporting drilling fluid flowing from the well back to the settling tank system. A variable capacitance type flow sensor is mounted within the intermediate section of the drilling fluid return line and provides an electrical output signal proportionate to the level of the drilling fluid flowing through the parallelogram shaped chamber. Apparatus is mounted with the flow sensing means for receiving the electrical output therefrom and converting such output signal to indicate the volume of drilling fluid flowing from the well into the first settling tank.

BRIEF DESCRIPTION OF THE DRAWINGS

Other objects and advantages of the invention will become apparent upon reading the following detailed description and upon reference to drawings, in which like reference characters are used throughout to indicate like parts.

While the invention will be described in connection with preferred embodiments and procedures, it will be understood that it is not intended to limit the invention to those particular embodiments and procedures. On the contrary, it is intended that the invention encompass all alternatives, modifications and equivalents as may be included within the spirit and scope of the invention as defined by the appended claims.

DETAILED DESCRIPTION OF THE INVENTION

Figure 1:
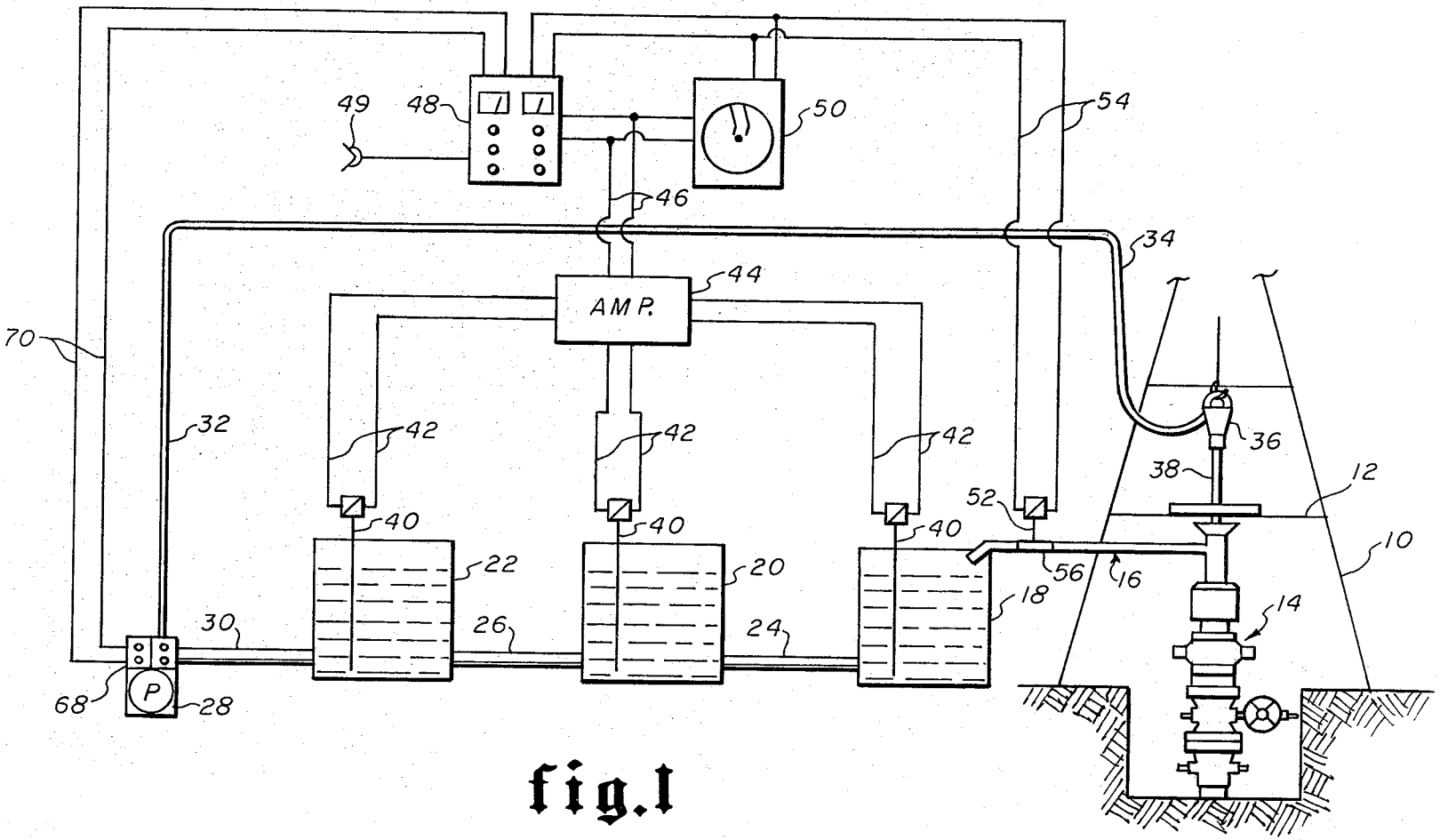
FIG. 1 is a schematic view of a preferred embodiment constructed according to the present invention.
Figure 2:
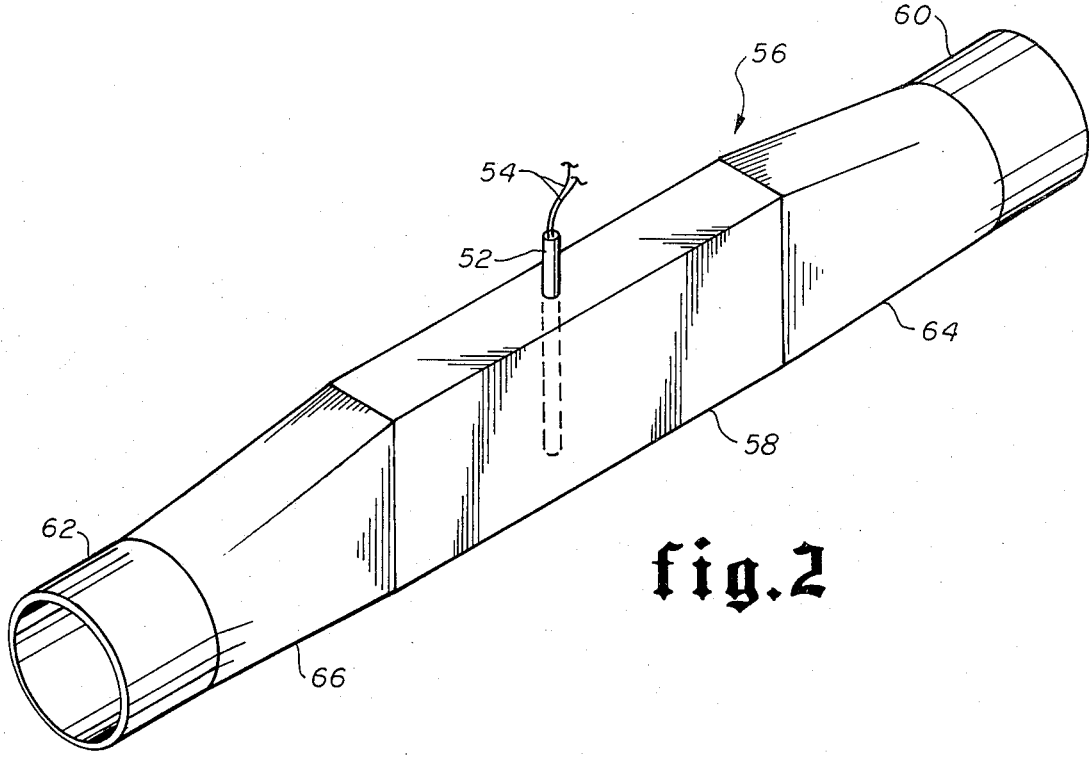
FIG. 2 is a perspective view of a portion of the invention shown in FIG. 1.
Figure 3:
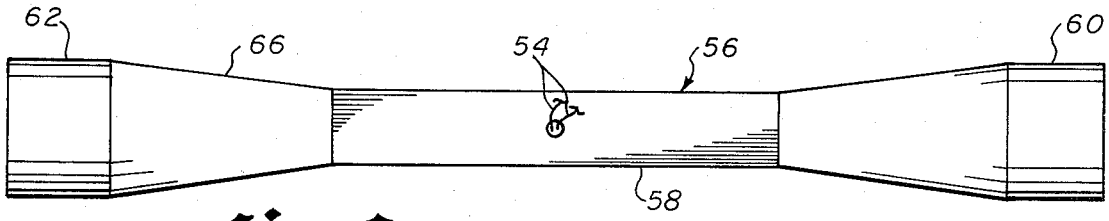
FIG. 3 is a plan view of the portion of the invention shown in FIG. 2.
Figure 4:
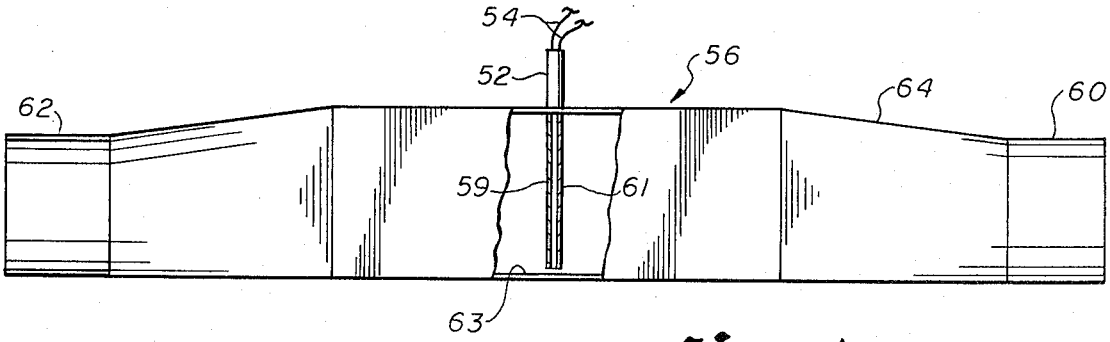
FIG. 4 is an elevational view of the portion of the invention shown in FIG. 2.

Referring now to the drawings and first to FIG. 1, there is schematically shown a drilling fluid circulating system which is disposed near a drilling rig 10 having a platform 12 and a wellhead 14. Extending from the bell nipple of wellhead 14 is a drilling fluid return line 16 which places the well bore (not shown) in fluid communication with a settling tank 18. A second settling tank 20 and suction tank 22 are mounted in fluid communication with settling tank 18 by a pipe 24 extending between settling tank 18 and second tank 20, and by a second pipe 26 extending between the second tank 20 and a suction tank 22.

Fluid circulation is induced by a pump 28 that withdraws drilling fluid from suction tank 22 via suction pipe 30 and forces such drilling fluid through a pipe 32 into a flexible hose 34 and thence to a swivel 36. A kelly 38, which is a generally rectangular tubular drive stem, receives drilling fluid from the swivel 36 and conducts the drilling fluid to the drill stem extending downwardly into the well bore. The drilling fluid exits the drill stem at the drill bit connected at the lower extremity thereof and then flows upwardly through the annulus between the drill stem and well bore carrying with it the drill cuttings that are cut from the formation by the rotating drill bit. The returning drilling fluid then flows from the well through return line 16 into settling tank 18.

Liquid level sensing devices 40 are mounted at the upper portions of tanks 18, 20 and 22 and provide electrical signals indicating the level of fluid in each of the tanks. The settling tanks are of known volume and thus the liquid level signals also indicate the volume of drilling fluid stored in the tanks. Accumulation of the liquid level signals reflects the total volume of drilling fluid stored at the surface. The liquid level sensing devices emit electrical signals which are transmitted by conductors 42 to an amplifier circuit 44. Liquid level sensors 40 may be of any conventional form, however, it is preferred that they be of the parallel plate capacitance type, such as those described in the related application previously identified. The signals of each of the liquid level indicators are processed by the amplifier circuitry and a signal representing the cumulative liquid levels of the tanks is presented as an amplifier output signal. Amplifier 44 is shunted by conductors 46 to an indicator 48 and a recorder 50 which provide visual information from which the status of the drilling fluid system is determined, as explained hereinbelow.

Since pump 28 is a typical reciprocating type mud pump, the volume of the pump is indicated by accumulation of pump stroke signals. A conventional pump stroke counting device 68 is interconnected with pump 28 and provides electrical signals representing each stroke of the pump. The electrical signals of the pump are conducted to indicator circuit 48 by means of conductors 70, thereby providing electrical meter representation at the indicator circuitry of the volume of injected drilling fluid developed by pump 28.

A liquid level gauge 52 is mounted in drilling fluid return line 16 and the electrical output signal thereof is transmitted to indicator 48 and recorder 50 by conductors 54. The return line 16 is open to the atmosphere at its outlet and the drilling fluid flowing therethrough is not under pressure. The flowing returning drilling fluid therefore seeks a level within Measurement of the depth or level of the fluid within return line 16 will provide an accurate indication of the volume of drilling fluid flowing from the well. The volume of fluid flowing through return line 16 is thus displayed by indicator 48 and recorded by recorder 50. In the event there should be no fluid flowing through return line 16 or in the event flow is reduced from an expected or predetermined rate, an audible alarm signal 49 may be activated to alert the drilling personnel of lost or insufficient circulation.

To overcome the difficulty of calculating the volume of drilling fluid flowing through return line 16, which is typically of circular cross-sectional configuration, a flow measurement chamber of section 56 is interconnected into the return line. The flow measurement section 56 functions to convert the flowing fluid to a cross-sectional configuration that is easily and simply measured. The internal configuration of section 56 defines a parallelogram and, by simply measuring the depth or level of fluid within the chamber, the cross-sectional configuration of the flowing fluid is readily determined. By relating the liquid level to known liquid level measurements at known rates of flow, the rate or volume of flow of the returning drilling fluid is clearly apparent.

Liquid level measuring device 52, which is also preferably a parallel plate variable capacitance type device, is mounted in a flow measurement section 56 that is interconnected with drilling fluid return line 16. Flow measurement section 56 incorporates an intermediate section 58 defining an internal chamber of parallelogram cross-sectional configuration. Inlet and outlet connector portions 60 and 62 of flow measurement section 56 are provided for connection of section 56 into the return line 16 and may be provided for connection therewith by any suitable form of connection, such as threaded or welded connection, for example.

An inlet transition portion 64 is mounted between inlet portion 60 and intermediate portion 58 to define a transition from the circular cross-section of the return line 16 to the rectangular cross-section of the intermediate section 58. An outlet transition portion 66 is mounted between intermediate portion 58 and outlet portion 62 to provide a transition from a rectangular cross-section back to circular cross-section for connection with the outlet portion 62. The outlet portion is connected to a conduit arranged to discharge into tank 18. It is preferred that the bottom walls of portions 58, 60, 62, 64 and 66 be essentially coextensive to eliminate variations in head pressures. Also, it is preferred that the side walls of the intermediate section 58 define right angles with the bottom wall and, more preferably, that the parallelogram shape be of rectangular configuration to eliminate variations in head pressures. Further, it is preferred that the circular cross-section of the inlet and outlet portions, 64 and 66, respectively, define substantially the same cross-sectional area as is defined by the intermediate portion 58 to eliminate variations in pressure as the flowing drilling fluid transitions these areas.

The liquid level measuring device 52 extends through the upper wall 57 of the intermediate section 58 and presents a pair of generally parallel plates 59 and 61 that extend to a position near the bottom wall 63 of the intermediate section. Plates 59 and 61 define a variable capacitor, the capacitance variation of which is determined by the level of fluid within the chamber defined by the intermediate section. The electrical signal transmitted by conductors 54 reflects the level and thus the volume of fluid flow through the flow measurement chamber.

From the foregoing it will be seen that this invention is one well adapted to attain all of the ends and objects hereinabove set forth, together with other advantages which are obvious and inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, and it is to be understood that all matter herein set forth or shown in the accompanying drawings is to be interpreted as illustrative and not in a limiting sense.

This invention having been described, what is claimed is:

1. A drilling fluid circulating system, comprising:

tank means for storing a quantity of drilling fluid used in a well;

means mounted in fluid communication with said tank means for pumping the stored drilling fluid into the well;

a drilling fluid return line mounted in fluid communication with the well for transporting drilling fluid from said well to said tank means, said drilling fluid return line including a section thereof having an interior of parallelogram cross-section;

flow sensing means mounted with said drilling fluid return line for providing an electrical output proportionate to the level of the drilling fluid flowing through the parallelogram cross-section; and means mounted with said flow sensing means for receiving the electrical output therefrom to indicate the volume of drilling fluid flowing into said tank.

2. The system of claim 1, wherein said parallelogram cross-section defines a rectangular shape.

3. The system of claim 2, wherein:

said drilling fluid return line further includes a first transition element mounted on the inlet side of the parallelogram section with the interior of the first element transitioning from a circular cross-section to the rectangular cross-section, and a second transition element mounted on the outlet side of the rectangular section with the interior of the second element transitioning from a rectangular cross-section to a circular cross-section.

4. The system of claim 3, wherein:

the circular cross-sectional areas defined by the first and second transitional portions and the cross-sectional area defined by said rectangular section are substantially the same.

5. The system of claim 4, wherein:

the interior bottom of the portions are substantially co-linear with respect to one another.

6. The system of claim 5, including:

means mounted with said pumping means for counting the number of strokes; and means mounted with said tank means for monitoring the volume of drilling fluid contained therein.

7. A drilling fluid monitoring system, comprising:

measuring means mounted with a drilling fluid storage tank for providing an output proportionate to the level of drilling fluid contained within the tank;

pump stroke counting means mounted with a drilling fluid circulation pump for providing an output representative of the volume of drilling fluid being pumped from the tank into the well;

flow sensing means mounted with a drilling fluid return line transporting the drilling fluid from the well to the tank and providing an electrical output signal proportionate to the level of drilling fluid flowing through a section of the return line, said section including an interior defining a cross-section in the shape of a parallelogram; and means (i) mounted with said measuring means for indicating the volume of drilling fluid contained in the tank, (ii) mounted with said pump stroke counting means for indicating the volume of drilling fluid being pumped into the well, and (iii) mounted with said flow sensing means for indicating the volume of fluid flowing from the well into the tank.

8. The system of claim 7, wherein: said interior defining a cross-section in the shape of a parallelogram defines a rectangular internal configuration.

9. The system of claim 8, wherein:

said drilling fluid return line further includes a first transition element mounted on the inlet side of the parallelogram portion with the interior of the first portion and transitioning from a circular cross-sectional internal configuration to a rectangular internal cross-sectional configuration, and a second transition element mounted on the outlet side of the rectangular section with the interior of the second portion transitioning from a rectangular internal cross-sectional configuration to a circular internal cross-sectional configuration.

10. The system of claim 9, wherein:

the circular cross-sectional areas defined by the first and second transitional elements and the cross-sectional area defined by the rectangular section are substantially the same.

11. The system of claim 10, wherein:

the interior bottom of the portions being substantially co-linear with respect to one another.

12. A method of monitoring changes in fluid circulation of a drilling fluid circulation system, comprising:

recording an output from a measuring means mounted with a drilling fluid storing tank for determining the quantity of fluid supported within such tank;

counting the number of strokes of a drilling fluid circulating pump for determining the quantity of fluid flowing into the well from the tank;

causing drilling fluid returning from the well to flow through a flow measurement section of a parallelogram shaped internal cross-section as the returning drilling fluid flows through a drilling fluid return line;

developing an electrical output signal from a fluid level sensing device mounted in the parallelogram shaped flow measurement section of the drilling fluid return line; and processing said liquid level output signal to reflect the volume of drilling fluid flowing through said return line.

13. The method of claim 12, including:

transitioning the flow of drilling fluid in the return line from an arcuate cross-section to a right angled parallelogram cross-section and then back from the parallelogram cross-section to the arcuate cross-section.

14. The method of claim 13, including:

maintaining the lowest portion of the flowing drilling fluid substantially co-linear during such transitioning.

15. The method of claim 14, including:

maintaining the cross-sectional area of said returning drilling fluid substantially uniform during flow thereof through said return line, thereby preventing variation in pressure during said transitioning and promoting accurate volumetric flow measurement with liquid level sensing.

* * * * *